US006095954A

United States Patent [19]

Svanberg

[11] Patent Number: 6,095,954

[45] Date of Patent: Aug. 1, 2000

[54] TRAINING APPARATUS

[75] Inventor: Jarl Svanberg, Boden, Sweden

[73] Assignee: Agaton Fitness AB, Boden, Sweden

[21] Appl. No.: 09/264,823

[22] Filed: Mar. 9, 1999

Related U.S. Application Data

[63] Continuation of application No. PCT/SE98/00014, Jan. 9, 1998.

[30] Foreign Application Priority Data

Jan. 10, 1997 [SE] Sweden ..... 9700057

[51] Int. Cl.[7] ..... A63B 21/06

[52] U.S. Cl. ..... 482/99; 482/5; 482/113

[58] Field of Search ..... 482/5–7, 93, 98–103, 482/112, 113

[56] References Cited

U.S. PATENT DOCUMENTS 4,540,171 9/1985 Clark et al. .
4,546,971 10/1985 Raasoch .
4,709,919 12/1987 Cano ..... 482/5
5,328,429 7/1994 Potash et al. .

FOREIGN PATENT DOCUMENTS 0 655264 5/1995 European Pat. Off. .

*Primary Examiner*—John Mulcahy
*Attorney, Agent, or Firm*—Young & Thompson

[57] ABSTRACT

Training equipment with a first (2) and a second (4) weight magazine, which produce a variable resistance force in a line in the shape of a first toothed belt (10), to which a draw handle is connectable for the application of muscle force (F1) . The first toothed belt (10) loaded by the mass (M1) of the first weight magazine (2), and a second toothed belt (12) is loaded by the mass (M2) of the second weight magazine (4), which second toothed belt furthermore is connected to a pneumatic operating cylinder (26), which is supplied by means of an operating unit (28). The toothed belts are connectable by a locking yoke (32), and the operating cylinder is activable depending on control signals from the operating unit (28), which in turn reacts on signals from sensors (50, 54, 58) depending on the position (V1; V2) of the first magazine (2). Through alternatingly coupling together the toothed belts (10; 12) with each other, it is possible to load the first toothed belt (10) with either the mass (M1) or the sum of the masses (M1) and (M2).

10 Claims, 2 Drawing Sheets

TRAINING APPARATUS

CROSS REFERENCE TO RELATED APPLICATION

This is a continuation of International application PCT/SE98/00014 filed on Jan. 9, 1998, which designates the United States of America.

FIELD OF THE INVENTION

The invention relates to a training equipment of the type which is stated in the introduction to the following claim 1.

BACKGROUND OF THE INVENTION

Equipment of this type is known in the prior art from EP-A1-0 655 264 which shows a training device provided with foot plates which are displaceable along a beam against the tractive force of a cable connected to the foot plates, the cable in turn being influenced by a motor which is controlled by means of a control unit. The control unit makes it possible to predetermine the characteristics of the load exerted by the motor.

The equipment according to the invention is similarly provided with a device which is controllable in order to determine the characteristics of the load which acts on an operating means, e.g. footplates, handles or levers of various types, attached to the device. In particular, the load on the operating means is adjustable in such a way that the muscle group in question is made to work eccentrically.

A muscle has namely essentially three different ways of working. It can contract, and thereby for example bend ajoint, or it can work statically, i.e. be tensed without either becoming shorter or longer. Finally, the muscle can also work eccentrically; i.e. attempt to contract at the same time as it is forced to become longer.

A now scientifically grounded fact is that the power which muscles develop is greatest when they work eccentrically, next greatest when they work statically and least when they work concentrically. Top sportsmen have with this fact as a foundation pursued eccentric fitness training since the middle of the 80's, because it has been accepted that if every muscle is strongest when it works eccentrically then the most effective way of training them should also be through eccentric training. In 1991, Per Egil Rettsnes at Norges Toppidrottscentrum in Oslo, started a not yet published scientific comparison of the different methods of fitness training. In 1995, published scientific comparison of the different methods of fitness training. In 1995, the studies showed that eccentric fitness training is more effective than conventional concentric fitness training.

Concentric fitness training is consequently defined as training with the same load in both the concentric and the eccentric phases of a fitness training action.

Excentric fitness training is defined as training where the load increases at the transition from the concentric to the eccentric phase of a fitness training action.

Training equipment according to the prior art for eccentric training has in the rule a motor which produces the necessary load on the operating means. The motor can be a rotating motor or a linear motor which, for example, is driven electrically, hydraulically or pneumatically and which is controlled by a control unit which is programmable to increase the load at the transition from the concentric to the eccentric phase.

Sometimes, for example, direct current motors or hydraulic cylinders are used and for the control of these, the necessary special control units with associated electronic equipment are relatively complicated and costly and, moreover, the electronics are often unreliable and sensitive to disturbances and external influences. Furthermore, this "virtual" equipment lacks real weights, which is a disadvantage as the size and shape of the weights are experienced by many as a psychological indicator of the size of the load. In general, even the rattle of the weights at the end positions is experienced as an acknowledgement of the work performed.

SUMMARY OF THE INVENTION

The object of the invention is therefore to provide a training equipment of the type mentioned in the introduction which is simpler, cheaper and more reliable than earlier equipment and which furthermore provides a positive experience that the training is being performed in a correct manner. This is achieved with a training equipment of the type mentioned, which has the characteristics stated in the following claim 1. Advantageous developments and improvements as well as an embodiment of the invention are evident from the dependent claims.

The embodiment is described more closely in the following only as an example with reference to the accompanying schematic figures. According to the example the equipment is both driven and controlled by means of uncomplicated and reliable pneumatic cylinders and valves of conventional type, the detailed construction of which therefore is not touched upon here.

DETAILED DESCRIPTION OF THE INVENTION

Figure 1:
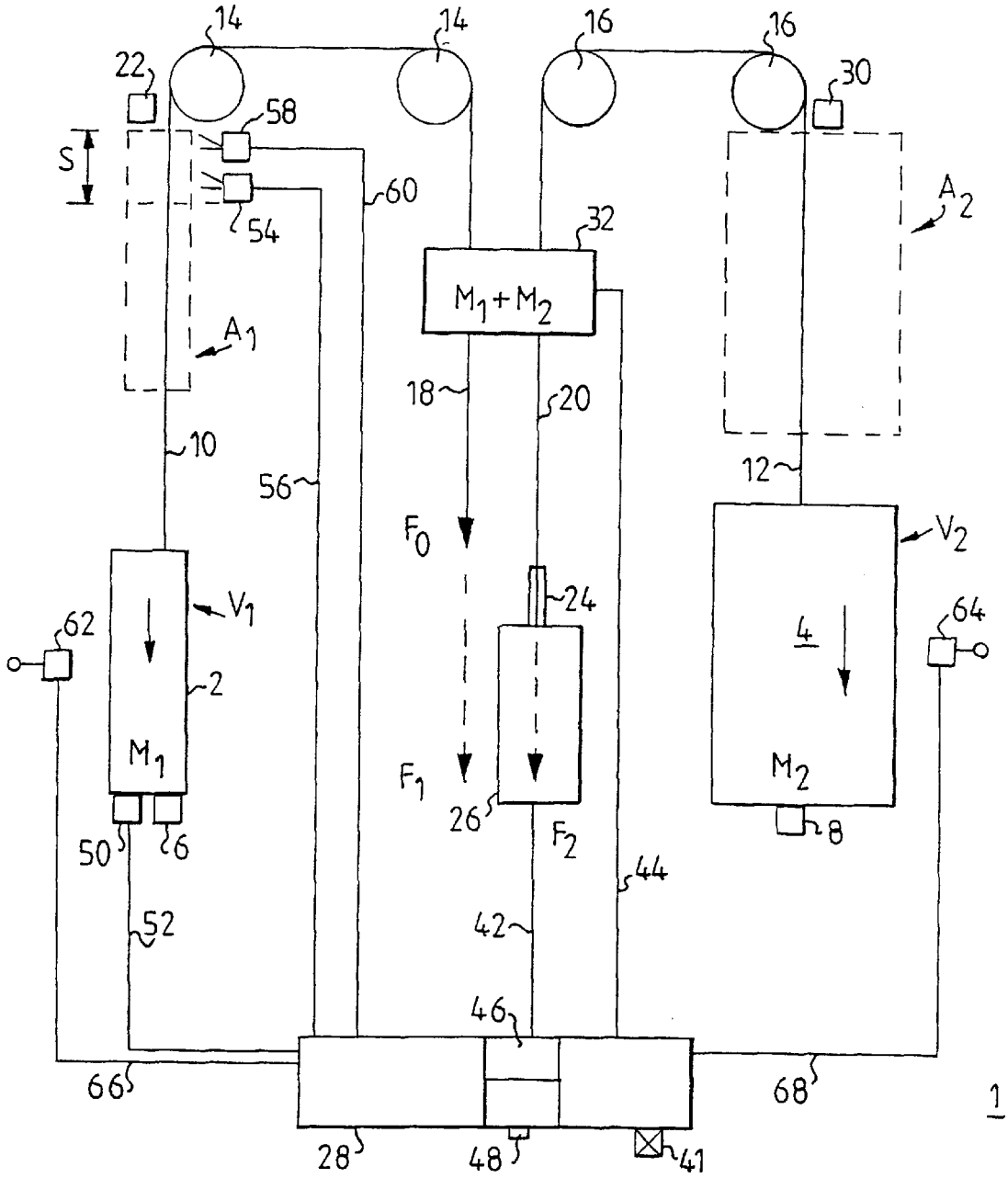
FIG. 1 shows a vertical view of a training equipment according to the invention with two weight magazines which are connectable together.
Figure 2:
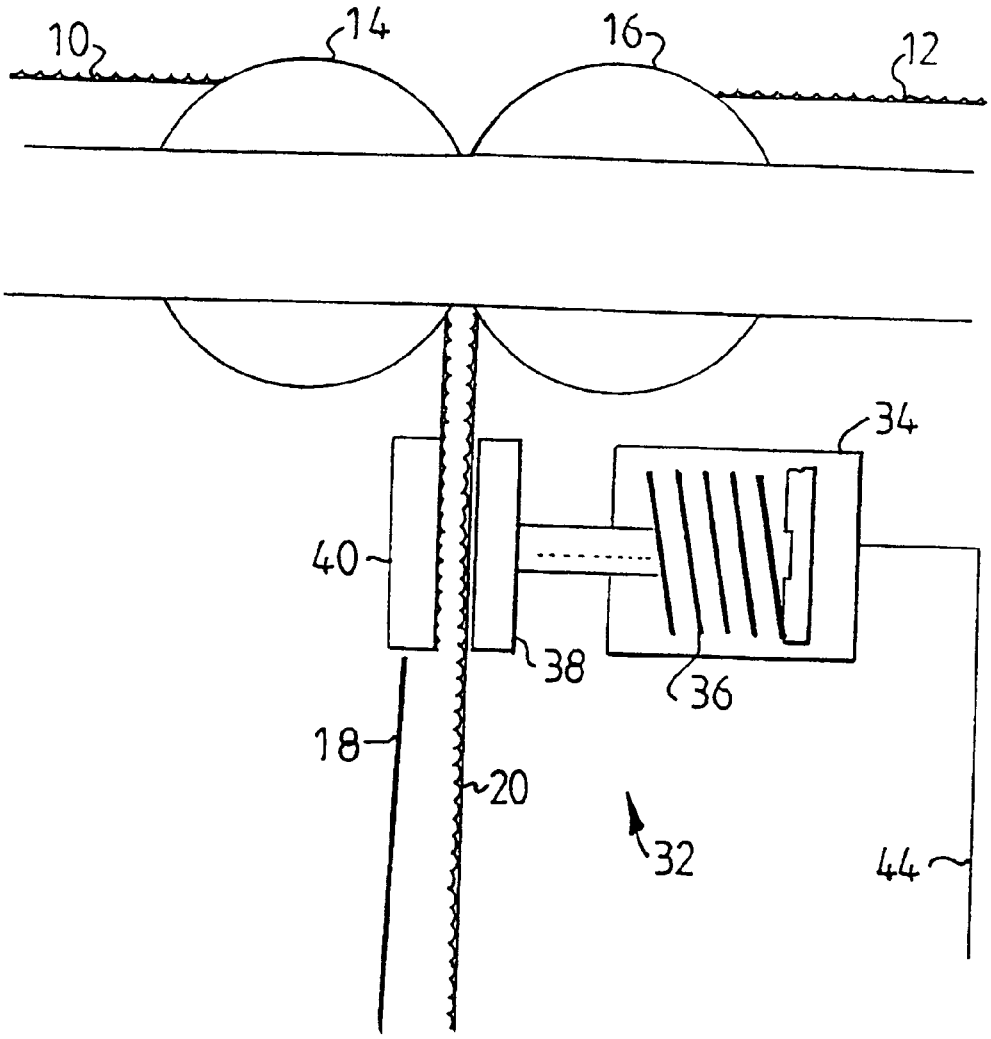
FIG. 2 is a view at a magnified scale of a coupling means of the equipment.

The training equipment is constructed on a stand (not shown), on which a first weight magazine 2 with the mass M1 and a second weight magazine 4 with the mass M2 in the respective rest position V1,V2, rest in contact each against their own end position stop 6,8. Each magazine is connected to its own line, e.g. a first 10 and a second 12 toothed belt, which run essentially vertically upwards from the respective magazine and which are deflected each by their own pair of pulley-wheels 14,16. From the pulley-wheels the outgoing parts 18 resp. 20 of the two toothed belts run essentially downwards near to each other but without touching each other and are parallel. The toothed belts are mounted in such a way that the teeth on the outgoing parts are facing towards each other.

The outgoing part 18 of the first toothed belt is provided in the conventional way with a (not shown) fastener for an (equally not shown) external training equipment, e.g. handles, oars, levers, foot pedals, bars etc. The toothed belts are in the unloaded state influenced by a force F0 and in the loaded state by a muscle force F1 which overcomes the mass M1 and consequently is able to lift the magazine 2 from the rest position V1 to the work position A1 in contact with the upper end position stop 22 attached to the (not shown) stand. If the muscle force diminishes in the direction towards F0 so that it becomes less than the mass M1, the magazine 2 returns to its rest position V1.

The outgoing part 20 of the second toothed belt is attached to a piston rod 24 of a pneumatic operating cylinder 26. The toothed belt in the unloaded condition is only influenced by the mass of the piston rod with attached piston, by the extent that this mass overcomes the actual friction forces. When the cylinder 26 is fed with compressed air by means of an operating unit 28, which preferably is a pneumatic unit 28, a force F2 is produced which overcomes the mass M2, which results in that the magazine 4 is lifted from its rest position V2 to its work position A2 in contact with an upper end position stop 30 attached to a (not shown) stand. As long as the cylinder 26 is activated by means of the pneumatic unit 28, the magazine 4 will remain in its work position A2 and return to the rest position V2 only when the cylinder is vented.

The outgoing parts 18 resp. 20 of the toothed belts run through a coupling means 32 which is formed as a lock yoke, which is attached to the part 18 of the toothed belt and which is operable by means of a locking cylinder 34 which is provided with a return spring 36. The cylinder acts on a movable cam box 38 on the yoke which, when the cylinder is activated, presses the toothed belts 18 and 20 towards a fixed part 40 of the yoke and into contact with each other and thereby locks the belts mutually via the teeth of the belts facing towards each other.

The operating unit or pneumatic unit 28 symbolizes a unit which contains conventional components (not shown), such as a compressed air source, in order to generate and regulate compressed air, for example by means of a compressor with a pressure accumulator comprising an air-treating unit with water separator, mist lubricator and manometer, and regulation and cut-off valves, a main valve for switching on air to the equipment and possible necessary electronics, and a start switch 41. In practice, most of the valves are as a rule situated in connection with their respective cooperating means.

Consequently, both the operating cylinder 26 and the cylinder 34 of the locking yoke are both provided with compressed air from the pneumatic unit 28 via an operating pipe 42 resp. a locking yoke pipe 44. The operating pipe is connected to the cylinder via a check valve 46 which is adjustable with the object of controlling the air supply to the cylinder and thereby the working speed of the cylinder, which determines the lifting speed of the second weight magazine. The cylinder has furthermore an adjustable venting valve 48 by means of which the cylinder can be vented with selectable resistance, from rapid venting to extremely slow venting, whereby the falling speed of the second weight magazine consequently is also controllable.

A number of sensing means or sensors, for example in the form of breakers, regulator valves, adjustable multipath valves, photocells etc., which can have pneumatic, electric or electronic operating circuits, are connected to the pneumatic unit. A first sensor 50 is situated in connection to the lower end position stop 6 of the first weight magazine 2 and arranged to, via a first signal pipe 52, supply a signal to the pneumatic unit 28 indicating whether the first weight magazine is in its rest position V1 or not.

A second sensor 54 is situated at a predetermined distance S from the upper end position stop 22 of the first weight magazine 2 and arranged to, via a second signal pipe 56, supply a signal to the pneumatic unit 28 indicating whether the first weight magazine has passed this distance S on its way towards the upper end position stop 22 or not.

A third sensor 58 is situated between the second sensor 54 and the upper end position stop 22 in connection thereto, and is arranged to, via a third signal pipe 60, supply a signal indicating whether the first weight magazine is in its working position A1 or not.

A fourth 62 resp. a fifth 64 sensor, are each arranged in connection with (not shown) protection devices, for example in the form of (likewise not shown) doors arranged in a protective casing for the respective first 2 and second 4 magazines, said doors preventing crushing injuries from occurring during training. These sensors 62;64 are arranged, via associated fourth 66 resp. fifth 68 signal pipes, to each supply a signal to the pneumatic unit 28 indicating whether the respective doors are closed or not.

As mentioned earlier, the pneumatic unit comprises known regulating means which, in dependence of the actual signals received via the pipes 52, 56, 60, 66 and 68, control the air supply resp. the venting of the operating cylinder 26 and the locking cylinder 34 in such a way that, for the current training situation, an optimal resistance is obtainable in the outgoing part 18 of the first cable or toothed belt 10.

The training equipment is placed in the ready state for training through switching of the start switch 41, which results in the (not shown) compressor producing the necessary over-pressure in the (equally not shown) pressure accumulator. If the sensors 62 and 64 indicate that the (likewise not shown) protective doors to the weight magazines are closed and the sensor 50 indicates that the first weight magazine 2 is in the rest position V1, the operating unit 28 opens the supply pipe 42 to the operating cylinder 26, the piston and piston rod 24 of which are displaced, and, via the second toothed belt 12 and the pair of pulley-wheel 16, the second weight magazine 4 is lifted from the rest position V2 to the working position A2. The magazine remains in the working position as long as the pressure is maintained in the operating cylinder. The equipment is now ready for use.

By means of a (not shown) further piece of equipment selected for the actual training occasion, the muscle force F1 is applied on the outgoing end 18 of the first toothed belt 10, which results in that the force F1, via this toothed belt and the pair of pulley-wheels 14, lifts the first magazine 2 from the rest position V1 to the working position A1. The sensor 50 indicates that the magazine is between the rest position and the working position for the operating unit 28, which locks the supply pipe 42. When the magazine 2 reaches the second sensor 54, this indicates that the magazine is at a distance S from the working position A1. This results in that the operating unit 28 opens the supply pipe 44 to the lock yoke 32, the locking cylinder 34 of which presses together the cam box 38 and the fixed yoke part 40 against the force of the return spring 36. The toothed belts are clamped towards each other between the box and the yoke part so that the teeth grip with each other and mutually lock together the belts.

During continued lifting movement the magazine finally reaches the third sensor 58 and impacts against the associated upper end position stop 22. The sensor 58 indicates that the magazine is in its working position A1, whereupon the operating unit 28 opens the venting valve 48 which vents to the atmosphere.

Since the toothed belts are mutually locked together, consequently both the mass M1 and the mass M2 act on the outgoing end 18 of the first toothed belt 10 and consequently load the actual muscle group until both of the magazines have reached their respective rest positions V1,V2. The first sensor 50 then indicates again to the operating unit 28 that the first magazine is in the rest position V1, and the operating unit again opens the supply pipe 42 to the operating cylinder 26 which lifts the second magazine to the working position, and a new sequence has begun.

Through both the check valve 46 and the venting valve 48 being adjustable, it is possible, by means of the check valve, to control the lifting speed of the second magazine 4. By means of the venting valve, which is adjustable between rapid venting and to different degrees of choking, it is possible to control the falling speed of the magazine 4.

Suitable values of the distance S lie within an interval of 15–60 mm, and a preferred value is 45 mm.

Each weight magazine contains as a rule a number of weight of conventional type which can be mutually locked together mechanically as required. Automatic magazines with rapid selection available on the market can likewise be connected to the training equipment and facilitates in this case an accurate adjustment to the desired load in the different training phases.

It is also possible to produce a further adjustment of the load by arranging suitable gearing of the outgoing part 18 of the cable 10 by means of gearing with one or more extra pulley-wheels.

The pneumatic components described in the above example can also, within the scope of the protection for the claims, be replaced by electrical, hydraulic or mechanical components for generation and control of the translational movements.

What is claimed is:

1. Training equipment with a drive means which produces a variable resistance force and which has operating means movable depending on this force, which drive means comprises at least a first (2) and a second (4) weight magazine and a motor (26) and which operating means comprises first lifting means (10) connected to the first magazine for application of a muscle force (F1) by means of which the first magazine (2) is movable between an associated rest position (V1) and an associated working position (A1), and the second magazine by means of second lifting means (12) is connected to the motor (26), which produces a machine force (F2), by means of which likewise the second magazine (4) is movable between an associated rest position (V2) and an associated working position (A2), wherein the magazines (2, 4) comprise each a first (10) and a second (12) line, the outgoing parts (18; 20) of the lines (10, 12) are situated adjacent to each other, and the magazines (2, 4) are mutually connectable together by a coupling means (32) through which the parts of the lines run.

2. Training equipment according to claim 1, wherein the lines (10,12), which run from the respective magazines (2,4) via pulleys (14;16), have mutually essentially parallel outgoing parts (18;20), the muscle force (F1) is applicable to the outgoing part (18) of the first line (10) and the motor (26) acts upon the outgoing part of the second line (12).

3. Training equipment according to claim 2, wherein both the coupling means and the motor are controlled from the position of the first magazine (2).

4. Training equipment according to claim 1, wherein an operating unit (28) is arranged to activate the coupling means (32) when the magazines (2,4) are situated in their respective working positions (A1,A2) and the motor (26) when the magazines are situated in their respective rest positions (V1,V2).

5. Training equipment according to claim 1, wherein the coupling means (32) is maneuverable by means of a pneumatic cylinder (34) provided with a return device (36), which is supplied and vented by an operating unit in the form of a pneumatic unit (28).

6. Training equipment according to claim 4, wherein the operating unit (28) has sensors (50,54,58) connected to the same, which are arranged in both the working position (A1) and the rest position (V1) for the first magazine (2), which sensors indicate in which position the magazine is, and at least one of the sensors (54) is situated at a predetermined distance (S) from the working position (A1) of the first magazine (2).

7. Training equipment according to claim 6, wherein the operating unit (28) has still more sensors (62,64) connected to the same, which are arranged to indicate the state of safety devices surrounding each of the magazines (2,4).

8. Training equipment according to claim 1, wherein each line, at least partly, is a toothed belt (10,12).

9. Training equipment according to claim 1, wherein the motor is a linear motor (26).

10. Training equipment according to claim 9, wherein the linear motor is a pneumatic cylinder (26), which is supplied and vented by the pneumatic unit (28) and the coupling means is a locking yoke (32).

* * * * *